US005685742A

United States Patent [19]

Reynolds

[11] Patent Number: 5,685,742

[45] Date of Patent: Nov. 11, 1997

[54] ELECTRICAL CONNECTOR

[75] Inventor: Howard Reynolds, Waterbury, Conn.

[73] Assignee: Molex Incorporated, Lisle, Ill.

[21] Appl. No.: 565,188

[22] Filed: Nov. 28, 1995

[51] Int. Cl.[6] ..... H01R 23/02

[52] U.S. Cl. ..... 439/676; 439/76.1

[58] Field of Search ..... 439/676, 344, 439/862, 76.1, 894

[56] References Cited

U.S. PATENT DOCUMENTS

| | | | |
|---|---|---|---|
| 3,369,214 | 2/1968 | Krumreich et al. | 439/676 |
| 4,732,568 | 3/1988 | Hall | 439/676 |
| 4,865,561 | 9/1989 | Collier et al. | 439/676 |
| 5,295,869 | 3/1994 | Siemon et al. | 439/620 |
| 5,447,441 | 9/1995 | Mueller et al. | 439/76.1 |
| 5,478,261 | 12/1995 | Bogese, II | 439/676 |

FOREIGN PATENT DOCUMENTS

| | | | |
|---|---|---|---|
| 0 585 731 A1 | 8/1996 | European Pat. Off. | H01R 9/109 |

*Primary Examiner*—David L. Pirlot
*Assistant Examiner*—Tho Dac Ta
*Attorney, Agent, or Firm*—A. A. Tirva

[57] ABSTRACT

A panel mounted angled modular jack assembly allows a mating modular plug to be inserted at an angle to the panel while permitting the jack contact assembly to be inserted perpendicular to the panel. A printed circuit board terminating ends of the contacts is mounted parallel to the panel allowing conductors to be terminated on an insulation displacement strip located on the board terminal in a direction perpendicular to the board and the jack mounting panel.

9 Claims, 7 Drawing Sheets

ELECTRICAL CONNECTOR

FIELD OF THE INVENTION

This application relates to electrical connectors, and particularly to electrical connectors used in telecommunications.

BACKGROUND OF THE INVENTION

A variety of telecommunications connectors are known in the prior art, each of which is used in different situations and so has different constraints on configuration. A known standard is the RJ 45 type connector used extensively in telecommunications for connecting equipment such as telephones and facsimile machines to a telephone line. The socket of this standard connector comprises a housing retaining eight wire contacts, each contact being held in a slot. A plug of this standard has eight corresponding blade contacts each retained within a slot. On insertion of the plug into the socket, each blade contact establishes electrical contact with one of the wire contacts to complete the communication circuit.

Connectors such as the RJ 45 type, and other telecommunications connectors, must conform to the respective connector wiring and configuration standard. Nonetheless, a variety of variations in connector shapes are known to enable sockets to be used in different operating conditions. For example, double socket outlets and trailing sockets require suitable housings to enable the socket to be fitted. Generally, all current telecommunications sockets which are mounted on a faceplate, or similar, are arranged to receive a plug inserted in a direction perpendicular to the faceplate. Other angles of insertion allow the plug to be inserted in such a manner that the wire attached to the plug may be more conveniently arranged for aesthetic considerations, reliability and safety. A plug inserted at right angles to a faceplate causes the cable attached to the plug to protrude causing a hazard as the cable stands proud of the faceplate surface. Connectors of this type are known in the art.

A problem with known angled connectors is that the mount to which socket wire contacts are mounted is difficult to connect to the associated connector, by which a cable is connected to the socket wire contacts to complete the circuit. In one known example, the socket contact mount is provided at an angle to the associated connector, and the resulting structure is weaker, and more complex to produce.

SUMMARY OF THE INVENTION

The invention aims to overcome the problems with known angled modules. Broadly, the invention provides a connector in which the contact mount and associated connector of a telecommunications socket are connected in a conventional manner whilst allowing the socket to accept a plug at an angle to the faceplate other than perpendicular.

More specifically, there is provided an electrical connector, comprising a housing having walls defining an aperture for receipt of an electrical plug insertable at the front of the connector in a direction parallel to a first axis an elongate contact having a non-contact establishing portion which is parallel to a second axis and which does not establish contact with an inserted plug, a spring portion, and a contact establishing portion for establishing contact with an inserted plug, wherein the contact establishing portion is at an angle to the non-contact establishing portion and is biased by the spring portion away from the non-contact establishing portion, and the upper end of the contact establishing portion is biased against a retainer, and wherein the contact establishing portion comprises a first portion and a second portion which are at an angle to one another.

An electrical connector embodying the invention allows an associated connector, such as an Insulation Displacement Connector, to be connected to the mount in a conventional manner. For example, an IDC block may be soldered to the rear of the contact carrying mount so that wires are inserted in to the IDC in the same direction as the mount is inserted into the rear of the aperture. A plug may then be inserted into the front of the aperture in a second direction, at an angle to the direction of mount insertion. The contacts in the mount may thus be easily connected to an associated connector, such as an IDC, without any problems of providing an angle between the mount and IDC. The plug may be inserted into the socket at an angle providing the advantages noted above, without any detriment to the manner in which the socket is connected.

BRIEF DESCRIPTION OF THE DRAWINGS

An embodiment of the invention will now be described, by way of example only, with reference to the accompanying drawings, in which.

DESCRIPTION OF PRIOR ART AND PREFERRED EMBODIMENT OF THE INVENTION

Figure 1:
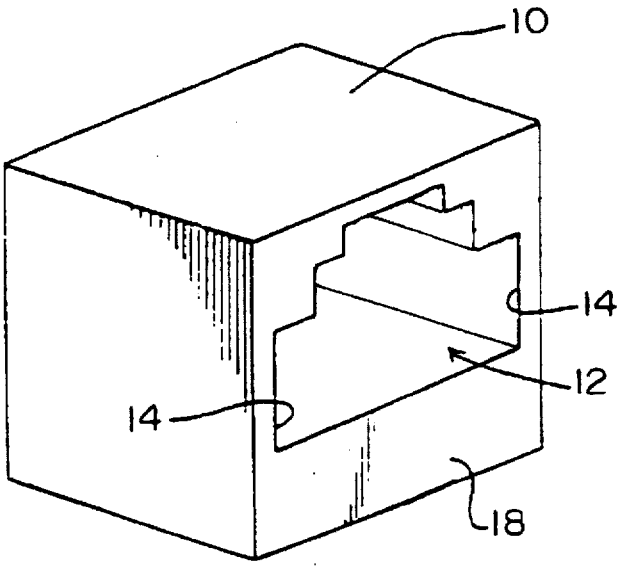
FIG. 1 (PRIOR ART)
FIG.1 is a simplified perspective view of a prior art socket.

A simplified view of a prior art RJ 45 socket is shown in FIG. 1. The socket comprises a housing 10 having walls 14 defining an aperture 12. The front face 18 of the aperture 12 is perpendicular to the direction of insertion of a plug into the socket. Such a socket would typically be attached to a coverplate, with the front face 18 parallel to the plane of the coverplate. The assembly so formed would then be mounted to an outlet box on a wall, or on office furniture.

Figure 2:
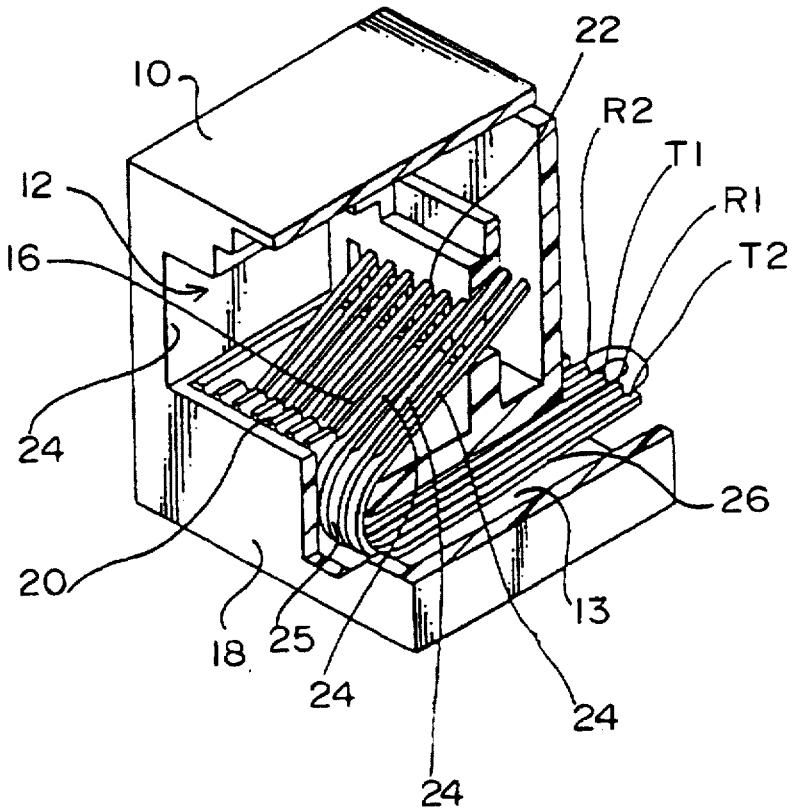
FIG. 2 (PRIOR ART)
FIG. 2 is a perspective cutaway view of the prior art socket of FIG. 1.

A cutaway view of the socket of FIG. 1 is shown in FIG. 2. The cutaway section reveals wire contacts 16 which are mounted in slots 20 within the housing 10. Each wire contact 16 is a spring wire with a contact establishing portion 24, and a non-contact establishing portion 26. To assemble the socket, the wire contacts 16 are inserted from the rear of the housing 10, each contact 16 passing into a slot 20. Initially, the non-contact establishing portion 26 and contact establishing portion 24 are roughly at right angles to one another. As the contact 16 is fitted from the rear of the socket, the upper end of the contact establishing portion 24 meets the upper wall 22 of the slot 20, causing the two portions to bend about the spring portion 25. Once fitted, the contact establishing portion 24 is biased upwards by the action of the non-contact establishing portion 26 against the lower wall 13 and the spring portion 25.

Figure 3:
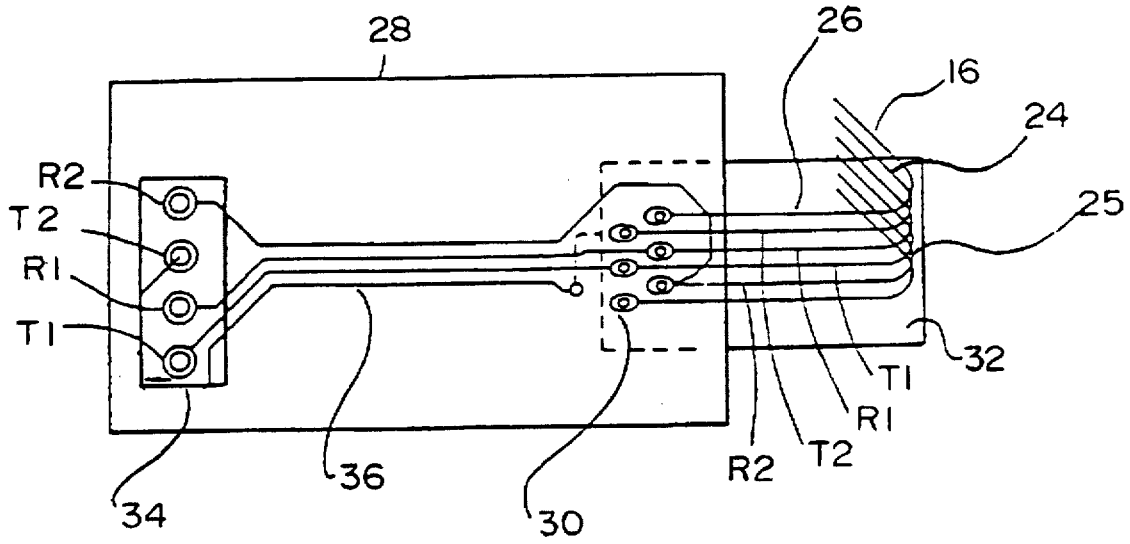
FIG.3 (PRIOR ART)
FIG. 3 is a schematic view of contacts of the connector of FIGS. 1 and 2 attached to a pcb.

On inserting a plug through the aperture 12, blade contacts in the plug meet the wire contacts 16 establishing electrical contact. As the plug is pushed fully into the socket, the blade contacts act against the wire contacts 16, pushing them away from the upper wall 22, against the biasing action of the spring portion 25. The biasing action ensures that the best possible contact between the blade contacts, and the electrical contact establishing portions 24 of the wire contacts, is achieved. The wire contacts 16 shown are denoted $R_2$, $T_1$, $R_1$ and $T_2$ following the usual wiring convention. Each wire contact will be connected to a wire via an IDC attached at the rear of the socket, usually via a soldered pcb. A schematic view of such a prior art connection is shown in FIG. 3.

As shown, each wire contact 16 is connected by soldering at solder point 30 to tracks 36 on the pcb 28. The pcb 28 is shown coplanar with the mount 32. However, in practice, the pcb and mount are at right angles to one another. The wire contacts 16 are denoted by the usual convention $R_2$, $T_2$, $R_1$, and $T_1$ as before. Each track 36 is connected at solder point 34 to an IDC. Wires of a cable will then be connected to the IDC to complete a circuit from the cable, to the IDC, to solder points 34, tracks 36, solder points 30 and to contact wires 16. The wire contacts are shown mounted to a mount 32 which support the wires as they are inserted into the rear of the socket. The non-contact establishing portions 26 are within the mount 32. The mount is shown more clearly in the cross section of FIG. 4.

The contacts 16 are mounted to the contact carrying mount 32 so that the non-contact establishing portion 26 passes through the centre of the mount 32. Each wire contact 16 is then soldered at solder point 30 to tracks on the pcb 28. An IDC block 38 is also soldered to the pcb 28 by solder point 34. A wire 40 of a cable is inserted into the IDC 38 in the direction shown by the arrow. Considering FIG. 2 and 3 together, it can be seen that the mount 32 (not shown in FIG. 2) carrying the contact wires 16 is inserted at the rear of the housing 10 in a direction perpendicular to the front face 18 of the housing. Once pushed fully home, the contact establishing portions 24 are located between slots 20 and meet the upper wall 22 at their upper end. The pcb 28 will then be flush with the rear of the housing and will be attached thereto with clips. This is shown more clearly in the schematic cross section of FIG. 4.

Once the mount 32, pcb 28 and IDC 38 are fitted to the housing 10, wires 40 are attached to the pcb 38 by insertion using an insertion tool in the direction shown by the arrow. Conveniently, the housing may be attached to the faceplate 11 prior to attaching the wires 40. This allows the person assembling the socket to push the wire 40 into the IDC 38 against the faceplate 11. As can be seen, with the IDC block 38 and the contact mount 32 parallel, and the pcb 28 perpendicular, the forces on the solder joints 30, 34 are kept to a minimum as the mount 32 is inserted into the housing 10, or as the wires 40 are inserted in to the IDC 38. This force is a minimum because the mount 32 and IDC block 38 butt against the pcb 28 and so the force is carried through the walls of these integers, rather than through the solder points 30, 34.

Figure 5:
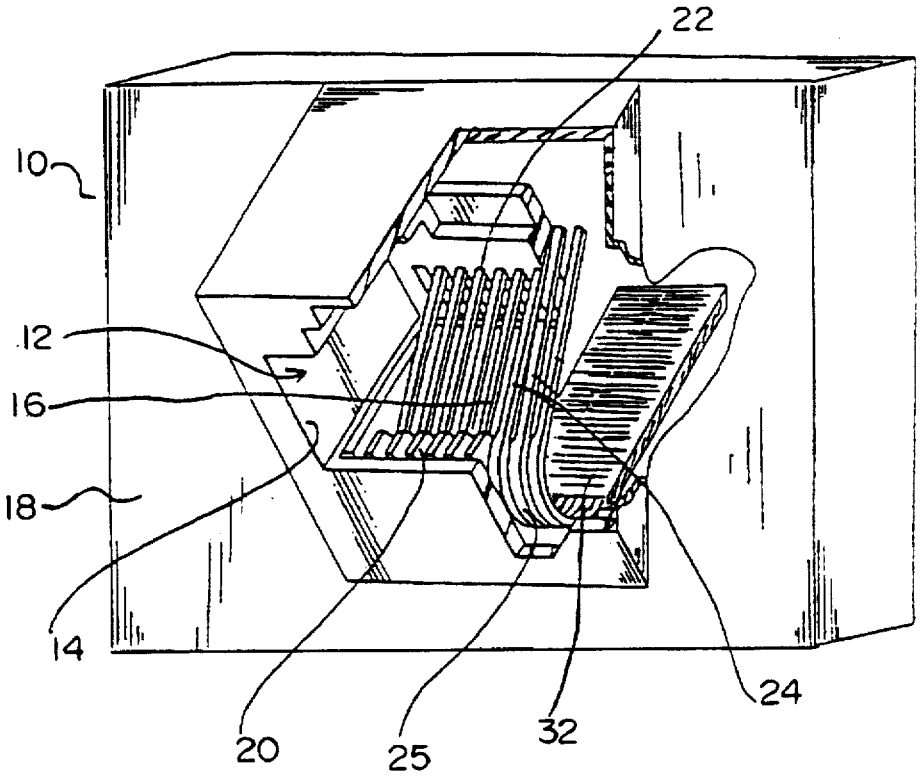
FIG.5 (PRIOR ART)
FIG. 5 is a perspective cutaway view of a second prior art socket.
Figure 6:
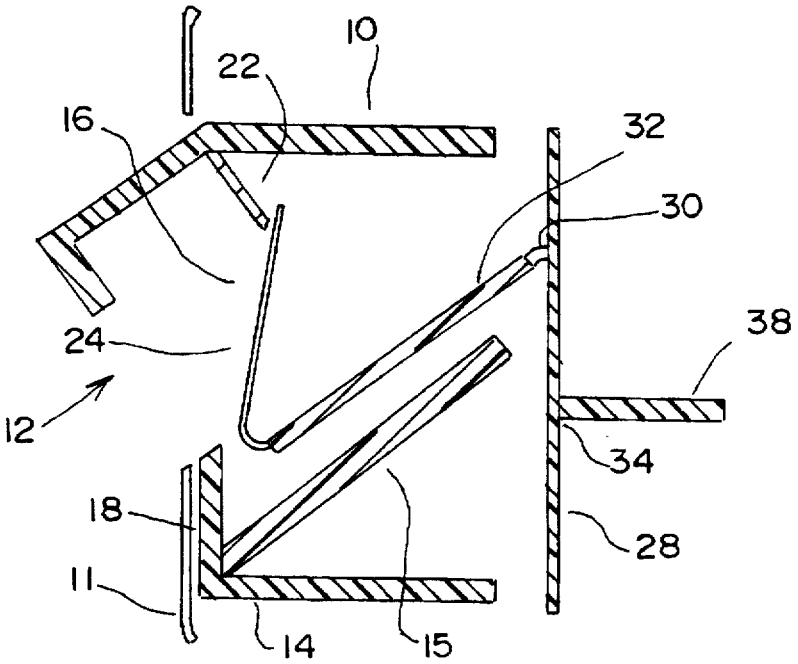
FIG.6 (PRIOR ART)
FIG. 6 is a schematic cross sectional view of the prior art socket of FIG. 5.

A second prior art connector is shown in FIGS. 5 and 6. This connector is similar to the connector shown in FIG. 2. However, the connector accepts a plug inserted at an angle to the front face 18 other than perpendicular. This provides the benefit that the wire attached to the plug drapes downwards from the connector and may lie along the surface to which the socket is attached, rather than protruding from it. As before, the socket comprises a housing 10 having an aperture 12 giving access to contacts 16 supported by a mount 32. At an upper end, the contacts are biased against the upper wall 22 of the slots 20. The wire contacts 16 comprises a contact establishing portion 24, a spring portion 25 and a non-contact establishing portion 26 within the mount 32. The mount 32, and contacts 16 are similar to those shown schematically in FIG. 3. The way in which the mount is introduced into the connector can be seen more clearly from the schematic cross section of FIG. 6.

Figure 4:
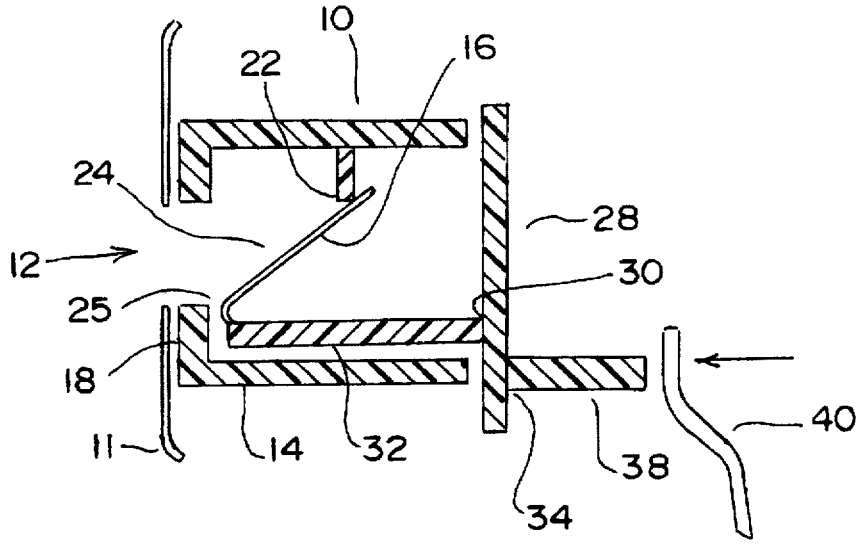
FIG.4 (PRIOR ART)
FIG. 4 is a schematic cross sectional view of the prior art socket assembly of FIGS. 1 to 3.

Referring to FIG. 6, the socket has the same integers as the prior art socket of FIG. 4. The housing 10 comprises walls 14 defining an aperture 12 in the front face 18. A bezel 11 is fitted to the front face 18. Within the housing, the contact wires 16 are mounted on the mount 32. As before, the mount 32 and IDC 38 are attached to the pcb 28 by solder points 30, 34. A further interior wall 15 is provided for supporting the mount 32 to allow the biasing action of the wire contacts to push against the upper wall 22. Now, the solder point 30 is strained as the mount 32 is inserted in the housing 10, as the force required to push the mount 32 against the biasing action of wire contacts 16 is no longer provided by the pcb 28 butting against the mount 32. Consequently, the solder point 30 is prone to failure due to the force upon it on insertion. Furthermore, this arrangement is more difficult to manufacture as the angle between the mount 32 and the pcb 28 must be carefully arranged and within a certain tolerance. As can be seen in FIG. 6, the angle is arranged by bending the wire contacts 16 at the tail end where they are soldered to the pcb 28. Additionally, the wire contacts 16 are arranged alternately with one above the other in the mount 32. The upper wire contacts 16 are slightly longer than the lower contacts so that a larger gap is provided between the mount 32 and the pcb 28 at the top of the mount than at the bottom. Because of the gap at point 30, the mount 32 and pcb 28 cannot be fixed together, and the wire contacts themselves provide the attachment of the mount 32 to the pcb 28. This arrangement allows the mount 32 to be angled with respect to the pcb 28. While this arrangement allows a plug to be inserted into the socket at an angle to the front face 18, the soldering and configuration is undesirably complex and prone to failure.

Figure 7:
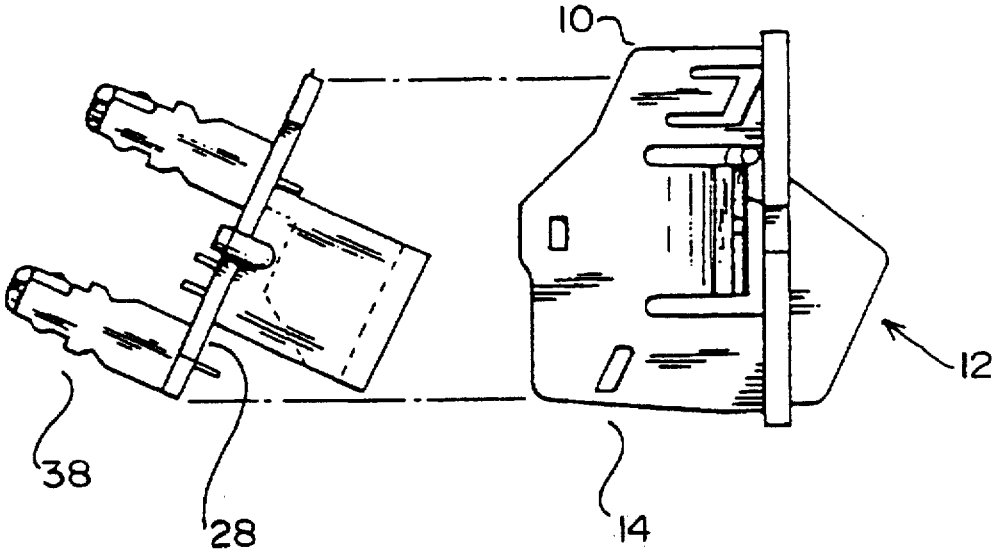
FIG. 7 (PRIOR ART)
FIG. 7 is a perspective view of a third prior art socket.
Figure 8:
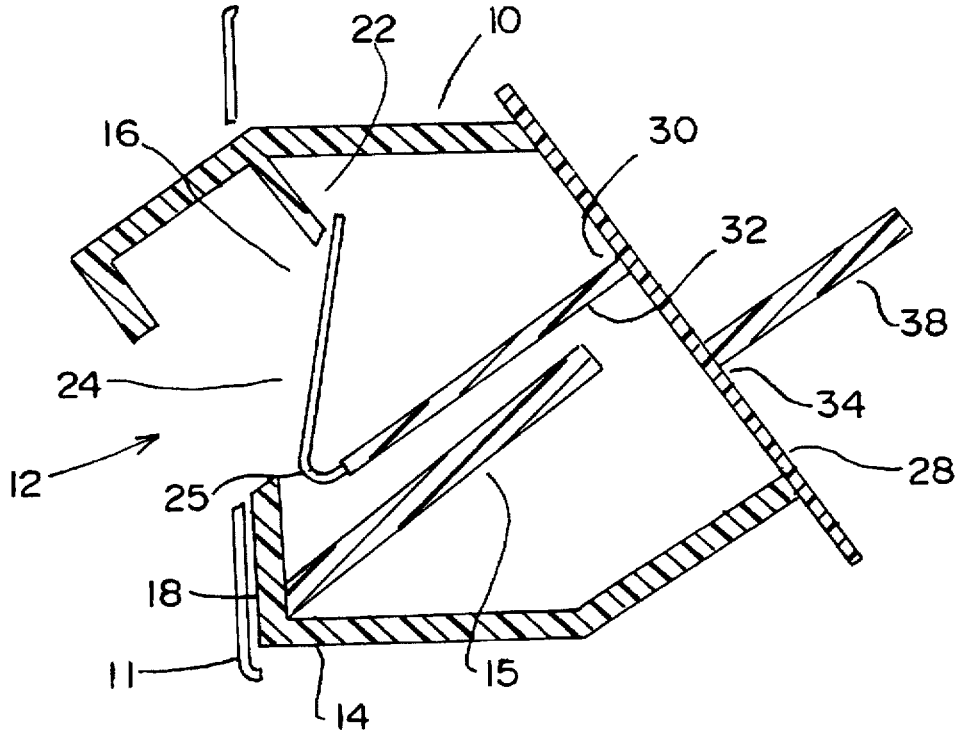
FIG. 8 (PRIOR ART)
FIG. 8 is a schematic cross sectional view of the socket of FIG. 7.

A third prior art connector is shown in FIGS. 7 and 8. This connector is also disclosed in U.S. Pat. No. 5,295,869. As with the first and second prior art connectors, the socket comprises a housing 10 having an aperture 12 giving access to contacts 16 supported by a mount 32. Other integers are labelled with numerals corresponding to those of the first and second embodiments. In this prior art connector, the mount is inserted at an angle to the front face 18 of the connector, as in the connector of FIG. 6. The mount 32 is at right angles to the pcb 28, which in turn is at right angles to the IDC 38, as in FIG. 4. Thus this connector provides a connector which receives a plug at an angle to the front face 18, but does not suffer the detriment of providing an angle between this mount 32 and the pcb 28. However, this connector now suffers the problem that wires must be attached to the IDC 38 by insertion at an angle to the front face 18. This is more awkward than inserting at right angles in FIGS. 4 and 6, and can cause failure of the socket by breaking the IDC 38 from the pcb 28 due to the insertion force. This is likely to occur as the insertion tool is awkward to operate at an angle, and will provide a component of force parallel to the pcb 28.

Figure 9:
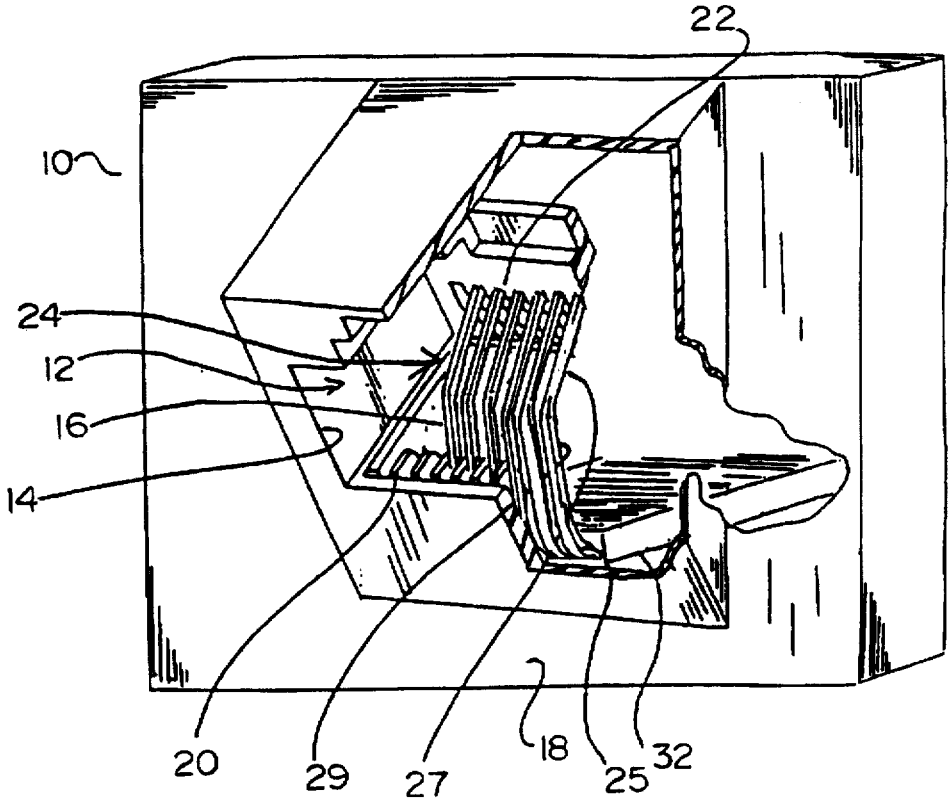
FIG. 9 is a perspective cutaway view of a socket embodying the invention.
Figure 10:
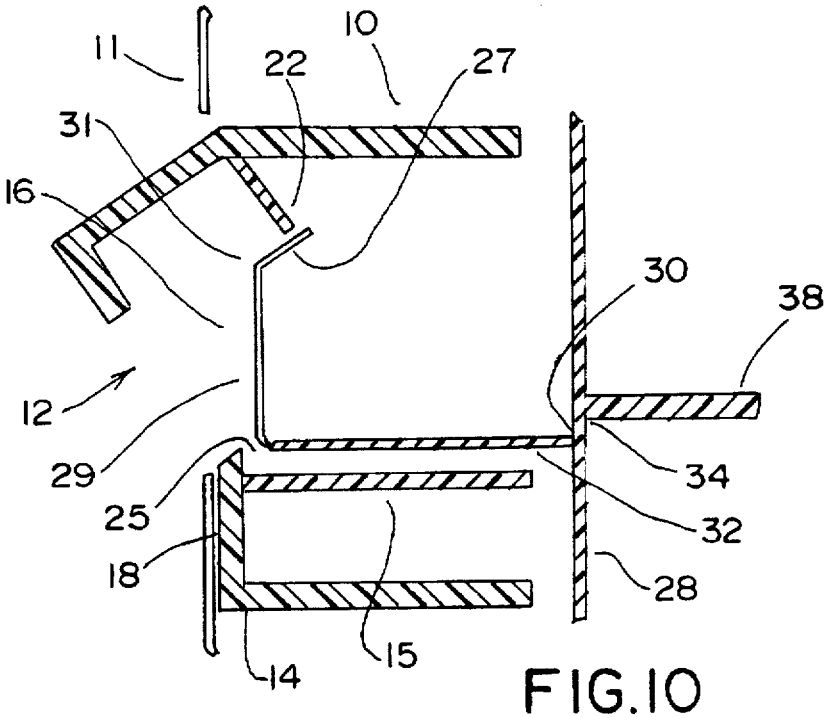
FIG. 10 is a schematic cross sectional view of the socket of FIG. 9.
Figure 11:
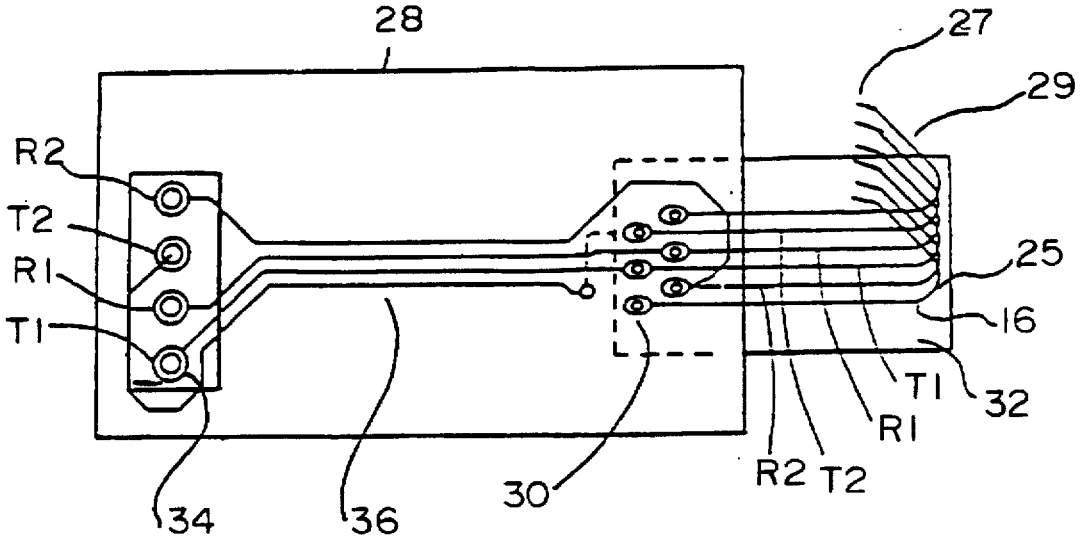
FIG. 11 is a schematic view of wire contacts embodying the invention attached to a pcb.

An embodiment of the invention is shown in FIGS. 9, 10 and 11. As with the three prior art sockets, the socket comprises a housing 10, having walls 14 defining an aperture 12, into which a plug may be inserted at an angle to the front face 18 of the socket, to establish conductive contact with wire contacts 16. The wire contacts 16 comprise a contact establishing portion 24, a spring portion 25 and a non-contact establishing portion held within a mount 32. Each contact is inserted into a slot 20 of the housing and is biased by the spring portion 25 against the upper wall 22 of the slot 20. Now, as best seen in FIG. 10, the mount 32 is inserted in a direction perpendicular to the front face 18, while a plug is insertable at an angle to the front face 18. This is possible because of the angle provided between the upper contact establishing portion 27 and the lower contact establishing portion 29. This angle between these first and second portions ensures that blade contacts of an inserted plug establish good conductive contact with the wire contacts 16. If this angle were not provided, the blade contact of a plug inserted into the socket would not establish proper contact with the wire contact 16. To establish good contact, the wire contact 16 should lie so that the contact establishing portion 24 is roughly parallel with, and establishes contact with, the flat side of the blade contact. Without the additional angle between the two portions 27 and 29, the wire contact would only make contact with a comer of the blade contact, rather than the flat side. This would not give effective contact.

The advantage of providing this angle can best be seen by comparing FIGS. 4, 6, 8 and 10. First, in FIG. 4, the mount and plug are inserted conventionally, perpendicular to the front face 18. The wire contacts 16 are bent back by the upper wall 22 and are biased against the wall by the spring portion 25. The wire contacts 16 establish conductive contact with blade contacts of an inserted plug by the biasing action of each wire contact against each blade contact. The angle of the contact establishing portion 24 with respect to the non-contact establishing portion held in the mount 32 is such that the biasing action is strong enough to establish good contact.

Next, in FIG. 6, the aperture 12, the mount 32 and contacts 16 are all provided at an angle to the front face 18. Consequently, the angle between the contact establishing portion 24 and the mount 32 is the same as in FIG. 4. However, the angle between the mount 32 and the pcb 28 is undesirable, as previously explained.

In FIG. 8, the aperture 12, the mount 32 and the contacts 16 are again all provided at an angle to the front face 18. However, the mount 32 and the pcb 28 are at right angles to one another alleviating the problem of providing the mount and pcb at an angle to one another as in FIG. 6. As a result, however, the pcb 28 is at an angle to the front face 18, and the IDC 38 is also at an angle, other than perpendicular, to the front face 18. This is also undesirable as previously explained.

Now, in the embodiment of the invention shown in FIG. 10, the angle between the mount 32 and the lower contact establishing portion 29 differs from that of the prior art. This is because the plug is insertable at an angle to the direction of insertion of the mount, and the wire contacts must be presented at a sufficient angle to the blade contacts of the plug for good conductive contact to be established. To achieve this angle of presentation, whilst maintaining sufficient biasing action of the spring portion 25, the upper and lower portions 27, 29 are provided at an angle to one another. In this embodiment this is shown as a sharp bend at bend point 31. This bend ensures that part of the contact establishing portion 24 is proud of the line between the upper wall 22 and the spring portion 25. By standing proud, a good conductive contact between the wire contact 16 and a blade contact is ensured. As previously described, this allows the mount 32 to be properly attached perpendicular to the pcb 28.

Figures 12A, 12B:
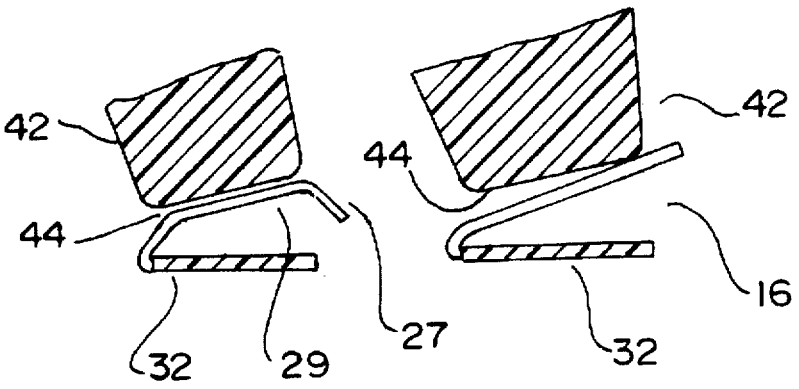
FIG. 12A is a schematic view showing the wire contact and a blade contact embodying the invention.
FIG. 12B is a schematic view showing the wire contact and a blade contact not embodying the invention.

FIGS. 12A and 12B show how the additional angle between contact portions 27 and 29 allows satisfactory electrical contact. First, FIG. 12B, shows how the blade would make contact if an angle were not provided in the connector of FIG. 10. The wire contact 16 meets a corner of the blade contact 42, rather than the intended flat surface 44. Now in FIG. 12A, the additional angle between the two portion 27 and 29 allows the wire contact to correctly meet the flat portion of the blade contact 42.

Figure 13:
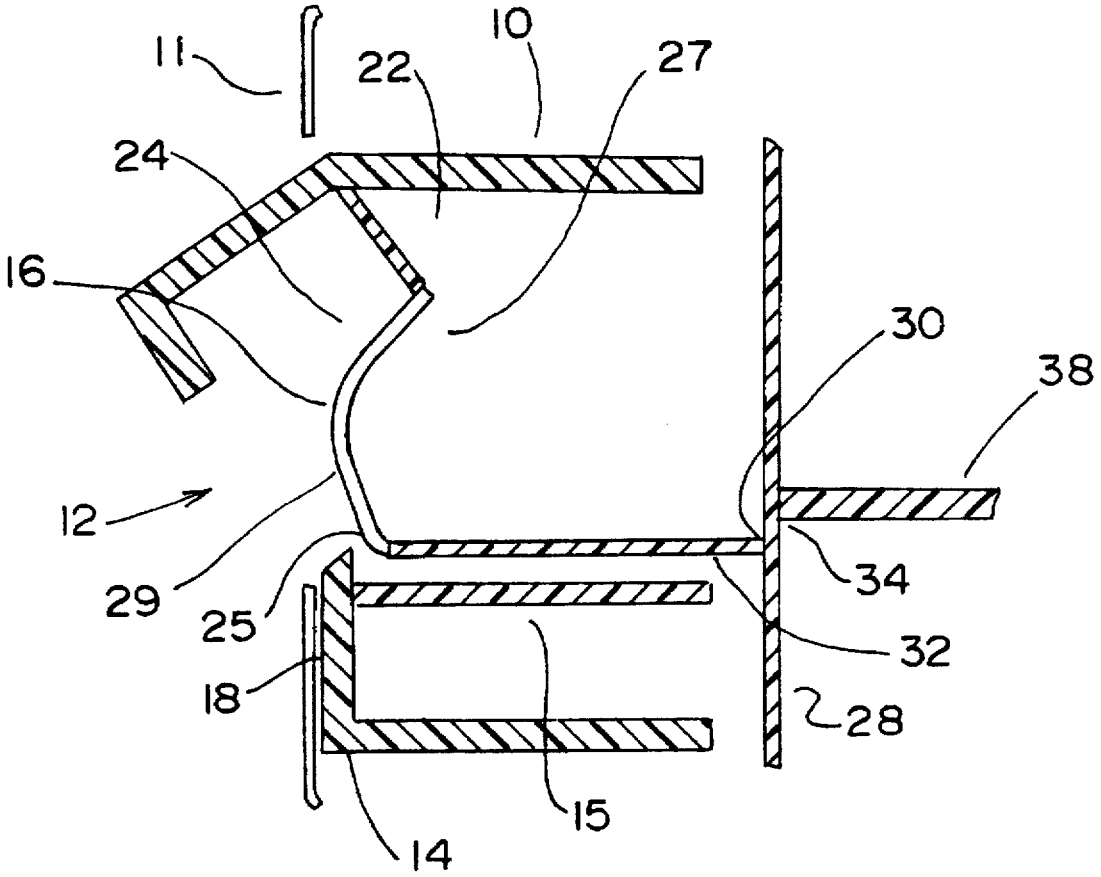
FIG. 13 is a schematic cross sectional view of a second embodiment of the invention.

A second embodiment of the invention is shown in FIG. 13. This embodiment differs from the first embodiment in that the contact establishing portion 24 of contact 16 is curved, rather than bent at a particular point. Nonetheless, the contact has an upper portion 27 and a lower portion 29 which are at an angle to one another. This allows the contact to correctly establish conductive contact with an inserted plug contact. The action of the contact in this embodiment is similar to that shown in FIG. 12. Curved shapes other than that shown may also be suitable and are within the scope of the invention.

While the invention has been described with respect to an RJ 45 type socket, it is clear that the invention could apply equally to other connectors. In particular, the wire contacts may be any suitable spring contact, and may be curved rather than bent at a particular point.

I claim:

1. An electrical connector, comprising a hosing substantially rectangular housing having substantially parallel top and bottom walls a front wall joining said top and bottom walls and defining an aperture for receipt of an electrical plug insertable at the front of said connector in a direction parallel to a first axis at an angle less than 90° to the plane of the front wall, an elongate contact having a non-contact establishing portion which is parallel to a second axis substantially perpendicular to the plane of the front wall, a spring portion, and a contact establishing portion for establishing contact with an inserted plug, wherein said contact establishing portion is at an angle to said non-contact establishing portion and is biased by said spring portion away from said non-contact establishing portion, and an upper end of said contact establishing portion is biased against a retainer, and wherein said contact establishing portion comprises a first portion and a second portion which are at an angle to one another.

2. The electrical connector of claim 1, wherein said contact is a wire contact.

3. The electrical connector of claim 1, wherein said contact establishing portion is bent at a bend point between said first and said second portions.

4. The electrical connector of claim 1, wherein said contact establishing portion is curved.

5. The electrical connector of claim 1, wherein said retainer is an upper wall of the housing.

6. The electrical connector of claim 1, wherein said non-contact establishing portion is mounted in a mount located within the connector housing.

7. The electrical connector of claim 6, wherein said non-contact establishing portion is attached at an end to a pcb.

8. The electrical connector of claim 7, wherein said non-contact establishing portion is soldered at right angles to said pcb.

9. The electrical connector of claim 7, wherein said pcb has an insulation displacement connector attached, said insulation displacement connector and said mount are parallel, and said pcb is perpendicular to said mount.

* * * * *